US006360895B1

(12) United States Patent
Riggenmann et al.

(10) Patent No.: US 6,360,895 B1
(45) Date of Patent: Mar. 26, 2002

(54) SEPARATING DEVICE FOR ELONGATE SOLID PIECES

(75) Inventors: Reinhold Riggenmann, Weissenhorn; Winfried Von Rhein, Freigericht; Helmut Werdinig, Nürnberg, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/718,938

(22) Filed: Nov. 22, 2000

Related U.S. Application Data

(63) Continuation of application No. PCT/DE99/01430, filed on May 11, 1999.

(30) Foreign Application Priority Data

May 22, 1998 (DE) ..... 198 22 996

(51) Int. Cl.[7] ..... B07C 5/12
(52) U.S. Cl. ..... 209/682; 209/379
(58) Field of Search ..... 209/660, 679, 209/682

(56) References Cited

U.S. PATENT DOCUMENTS 3,784,007 A * 1/1974 Skrmetta ..... 209/85
3,883,422 A * 5/1975 Ettlinger, Jr. et al. ..... 209/75
4,143,769 A 3/1979 Ripple ..... 209/544
4,391,374 A 7/1983 Krynock ..... 209/540
4,569,446 A * 2/1986 Kelley ..... 209/660

FOREIGN PATENT DOCUMENTS

| | | | |
|---|---|---|---|
| DE | 33 19 032 A1 | 11/1984 | ..... B07B/1/46 |
| EP | 0 302 310 A1 | 2/1989 | ..... C01B/53/00 |
| GB | 2 055 308 A | 3/1981 | ..... B07B/13/04 |
| WO | 97/26495 | 7/1997 | |

* cited by examiner

*Primary Examiner*—Donald P. Walsh
*Assistant Examiner*—Mark J Beauchaine
(74) *Attorney, Agent, or Firm*—Herbert L. Lerner; Laurence A. Greenberg; Werner H. Stemer

(57) ABSTRACT

A separating device for elongate solid pieces includes a vibrating base with longitudinal grooves having a depth which decreases in a conveying direction, to allow efficient separation of elongate solid pieces, in particular of short pieces of wire, and to allow the separating device to operate continuously. The longitudinal grooves are adjoined by elongate, e.g. V-shaped, screen openings for separating the elongate solid pieces. Wide solid pieces can slide over the screen openings. The separating device is suitable in particular for separating small pieces of wire out of pyrolysis residue from a pyrolysis plant.

13 Claims, 2 Drawing Sheets

SEPARATING DEVICE FOR ELONGATE SOLID PIECES

CROSS-REFERENCE TO RELATED APPLICATION

This application is a continuation of copending International Application No. PCT/DE99/01430, filed May 11, 1999, which designated the United States.

BACKGROUND OF THE INVENTION

Field of the Invention

The invention relates to a separating device which can be used to separate elongate solid pieces from other solid pieces.

In many areas of industrial application, it is necessary for solid materials which are contained in bulk material, for example, to be separated into a plurality of fractions. The fractions are generally divided according to different sizes, geometries or qualities of the solid materials. It is always desirable for the solid materials to be separated if the various solid fractions are to be supplied for further treatment.

In the construction industry, for example, building rubbish which is produced is separated from large and bulky debris fractions, which are then sorted and reused. The finer building rubbish which has been separated off is disposed of, for example, at a landfill site that is provided for that purpose.

In the waste disposal field, it is becoming ever more important to separate and sort the waste or remainders produced after waste reutilization in order to be able to dispose of those materials in as environmentally friendly a manner as possible. The separation of the waste may be carried out before reutilization of the waste, but may also form an essential process step in the waste reutilization.

Thermal processes are known for elimination of waste. In those processes the waste is incinerated in refuse incineration plants or pyrolysed, i.e. subjected to a temperature of approximately 400° C. to 700° C. with the exclusion of air, in pyrolysis plants. In both processes, it is sensible for the material which remains after incineration or after pyrolysis to be separated, in order for it either to be fed for reutilization or to be disposed of in a suitable manner. The aim is to minimize the residual material which ultimately has to be landfilled.

European Patent Application 0 302 310 A1, corresponding to U.S. Pat. No. 4,878,440, and a company publication entitled "Die Schwel-Brenn-Anlage, eine Verfahrensbeschreibung" [The Carbonization Plant, A Process Description], published by Siemens AG, Berlin and Munich, 1996, have disclosed, as a pyrolysis plant, a so-called carbonization plant in which essentially a two-step process is carried out. In the first step, the waste supplied is introduced into a carbonization drum (pyrolysis reactor) and carbonized (pyrolysed). The pyrolysis produces carbonization gas and pyrolysis residue. The carbonization gas is burned, together with combustible pieces of the pyrolysis residue, in a high-temperature combustion chamber at temperatures of approximately 1200° C. The resultant waste gases are then purified.

In addition to combustible pieces, the pyrolysis residue also contains noncombustible fractions. The noncombustible fractions are essentially composed of an inert fraction, such as glass, stones or ceramic, and a metal fraction. The valuable substances in the residue are sorted out and fed for reutilization. The sorting requires processes and components which ensure reliable and continuous operation.

In order to provide for reliable operation, it is often desirable for solid pieces having a certain geometry to be separated out, so that they do not impair the operation of downstream separating devices for the remaining solid material and enable that material to be separated further. Elongate solid pieces, in particular wire or fine stranded wires, often present a particular problem. Those wires can only be separated from the remaining solid material with very great difficulty and they block screen holes in screens. That is particularly the case if those elongate solid pieces lie below a certain size.

International Publication No. WO 97/26495 has disclosed a discharge configuration which has a conveyor device for conveying and separating pyrolysis residue. The conveyor device has a separating base which has a sawtooth-like profile and is vibrated in order to convey the pyrolysis residue. The fine fractions of the pyrolysis residue collect in the longitudinal grooves which are formed by the sawtooth-like profile. A bar screen for separating the fine fractions which have accumulated from the remaining coarse fractions is disposed at the end of the separating base. A drawback of that configuration is that large, wide and long fractions are also separated off together with the fine fractions, since they can align themselves in longitudinal grooves and fall through the adjoining bar screen. It is not possible to efficiently separate off fine wires or similar elongate solid pieces.

SUMMARY OF THE INVENTION

It is accordingly an object of the invention to provide a separating device for elongate solid pieces, which overcomes the hereinafore-mentioned disadvantages of the heretofore-known devices of this general type, which allows effective separation of elongate solid pieces and which permits continuous operation without disruptions.

With the foregoing and other objects in view there is provided, in accordance with the invention, a separating device for elongate solid pieces, comprising a vibrating base having a number of longitudinal grooves extended in a conveying direction, the longitudinal grooves having a depth decreasing along the conveying direction; and screen openings adjoining the longitudinal grooves for separating elongate solid pieces.

Due to the inherent mechanical movement, i.e. the vibrations of the vibrating base, the solid material which is placed onto the vibrating base is conveyed in the conveying direction. The elongate solid pieces are simultaneously aligned in the conveying direction in the longitudinal grooves. At the same time, elongate, wide solid pieces are initially also aligned in this direction. Due to the decrease in the groove depth, these wide pieces then orient themselves essentially parallel to the vibrating base, so that they slide over the screen openings which adjoin the longitudinal grooves. In contrast, the narrow elongate solid pieces fall through the screen openings, which are preferably in gap form, in the manner of a bar screen. The decisive advantage of the screen device lies in the fact that only elongate solid pieces, and not wide solid pieces, are separated off. The screen device is suitable in particular for separating off fine stranded wires which have a diameter of approximately 0.1 to 2 mm and a typical length of up to 15 mm.

The separation of the elongate, narrow solid pieces can be expressed by the following three steps:

a) Alignment of the elongate solid pieces, b) deflection of wide, elongate solid pieces, and c) separation of the elongate solid pieces through the screen openings.

In accordance with another feature of the invention, the side walls of the longitudinal grooves have an inclined shape in order to allow simple alignment of the wide solid pieces parallel to the vibrating base.

In accordance with a further feature of the invention, the vibrating base has a wavy profile or a sawtooth-like profile in order to provide for the elongate solid pieces to be aligned as easily and reliably as possible in the conveying direction.

In accordance with an added feature of the invention, the longitudinal grooves and the elongate screen openings in each case run parallel to one another in order to ensure operation without disruption.

In accordance with an additional feature of the invention, the screen openings extend all the way to the end of the separating device, as seen in the conveying direction. They are therefore constructed to be open at the end. This is an essential feature for ensuring that solid pieces do not accumulate or become jammed in the separating device since, for example in the case of an elongate screen opening with a circumferential edge, that piece of the edge which lies in the conveying direction would present a resistance to the flow of solid material. Pieces of material could become suspended from this edge, and could lead to the screen opening becoming blocked and therefore to the function of the separating device being disrupted.

In accordance with yet another feature of the invention, the screen openings widen in the conveying direction, in order to avoid blockages and to ensure that the solid material flows as well as possible. A force is applied in the conveying direction to pieces of material which have become jammed in the screen opening by the solid material which follows. The jammed piece of material can then be moved in the conveying direction and then falls through the widening screen opening.

In accordance with yet a further feature of the invention, for this purpose, the screen opening widens continuously, in particular in a V shape.

In accordance with yet an added feature of the invention, the edges of the screen openings have an elastic construction, in to which case only a slight force has to be applied in order to release any jammed pieces of solid material. At the same time, this reduces the load which jammed pieces of material exert on the separating device as compared to edges which do not have an elastic construction.

In accordance with yet an additional feature of the invention, the screen openings are provided at their edges with elastic tabs which narrow or taper to a point in the conveying direction, so that the screen openings widen in the conveying direction and can be manufactured easily. In this construction, the widening is formed by the tabs.

In accordance with again another feature of the invention, there is provided a cleaning rake with a number of tines. The tines can be introduced into the screen openings and can be moved in the conveying direction in the screen openings. This rake can be used to release any pieces of material which become jammed, so that the separating device can operate continuously. The cleaning rake can be moved when required, periodically or continuously into the screen openings. The widening of the screen openings is highly advantageous for releasing jammed pieces of solid material using the cleaning rake, since the cleaning rake only has to move the jammed pieces of material slightly in the conveying direction for them to be released and fall through the widened screen opening. Moreover, the elastic construction of the edges is particularly advantageous for minimizing the load on the cleaning rake.

In accordance with a concomitant feature of the invention, the vibrating base is made of metal in order to provide for a configuration which is as robust as possible.

Other features which are considered as characteristic for the invention are set forth in the appended claims.

Although the invention is illustrated and described herein as embodied in a separating device for elongate solid pieces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
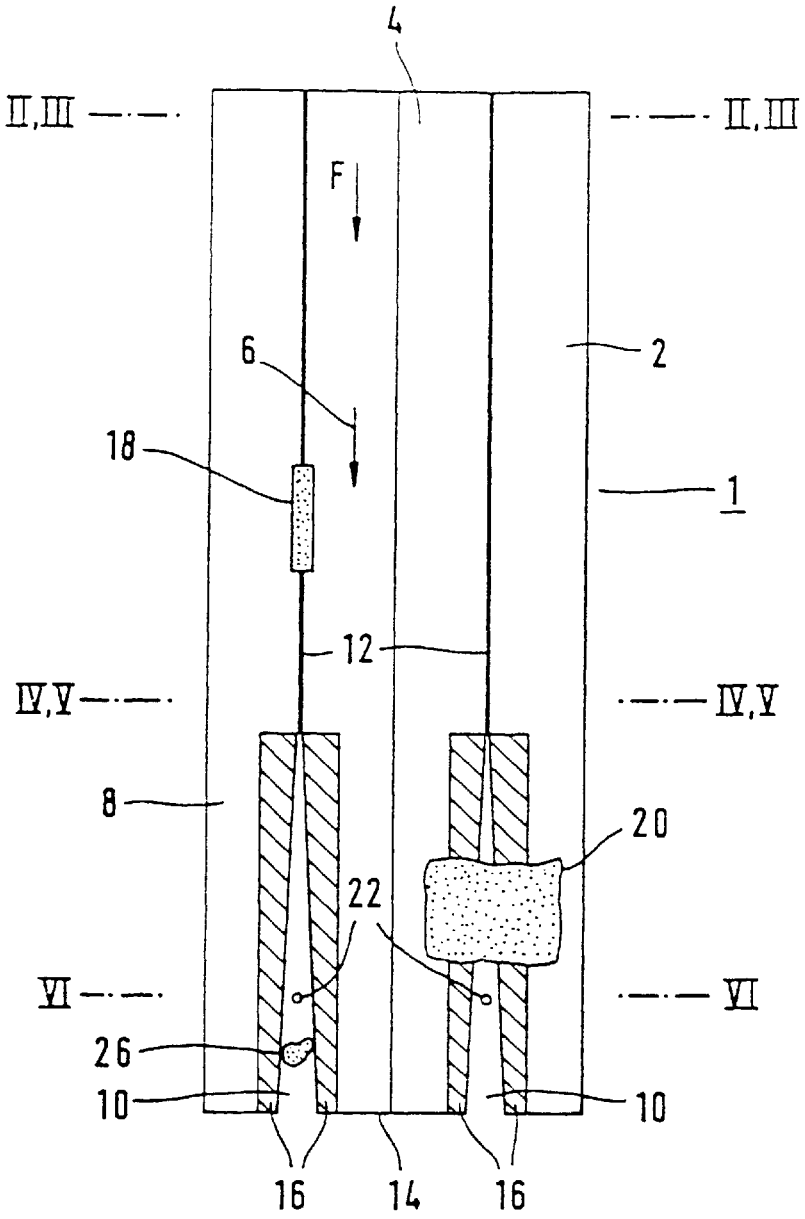
FIG. 1 is a diagrammatic, plan view of a separating device.

Referring now to the figures of the drawings in detail and first, particularly, to FIG. 1 thereof, there is seen a separating device 1 in which a metal vibrating base 2 extends from a feed area 4 for solid material F (e.g. pyrolysis residue from a pyrolysis plant), in a conveying direction 6, as far as a separation area 8. A number of elongate screen openings 10 which run in a V shape in the conveying direction 6 are disposed in the separation area 8, although only two of them are illustrated. A number of parallel longitudinal grooves 12 are provided in the vibrating base 2, although likewise only two are illustrated. Each longitudinal groove 12 opens into a respective one of the screen openings 10 as shown. Consequently, the screen openings 10 adjoin the longitudinal grooves 12 in the conveying direction 6 and widen continuously from these grooves until they reach an end 14 of the separating device 1. The depth of the longitudinal grooves 12 decreases towards the screen openings 10, as can be seen by comparing FIGS. 2 and 4 and by comparing FIGS. 3 and 5.

Two lateral edges of the respective screen openings 10 are elastic and, in particular, are constructed as tapering elastic tabs 16. The tabs 16 have an approximately triangular structure, so that the V shape of the screen openings 10 is formed by the two tabs 16.

The solid material F is fed onto the vibrating base 2 in the feed area 4. The solid material F is transported in the conveying direction 6 by the vibrations of the vibrating base 2 (produced through the use of a non-illustrated shaking device). Moreover, the vibrations of the vibrating base 2 lead to elongate solid pieces 18, e.g. pieces of wire, one of which is shown in FIG. 1, being aligned in the conveying direction 6 in the longitudinal grooves 12. The vibrating base 2 therefore conveys the solid material F and, at the same time, aligns the elongate solid pieces 18. The vibrations are produced, by way of example, with the aid of an eccentric drive.

It is sufficient for the longitudinal grooves 12 to have only a slight depth before they merge into the screen openings 10. The groove depth is dimensioned in such a way that the elongate solid pieces 18, once they have been aligned, are conveyed onwards in the conveying direction 6 in this aligned position. Therefore, the vibrating base 2 may have a virtually planar or planar construction in the area directly upstream of the screen openings 10. The decreasing groove depth aligns wide solid pieces 20, one of which is shown in FIG. 1, in a flat position essentially parallel to the plane of the vibrating base. Placing wide solid pieces 20 in a flat position is promoted by the shaking or vibrating movement of the vibrating base 2.

The aligned, elongate solid pieces 18 fall through the elongate screen opening 10 and are thus separated from the remaining solid material F. In contrast, the wide solid pieces 20, although they are also initially aligned by the longitudinal grooves 12, are then laid in a flat position, so that they slide over the screen openings 10 until they reach the end 14 of the separating device. They are only separated off when they reach the end 14 of the separating device.

Figure 6:
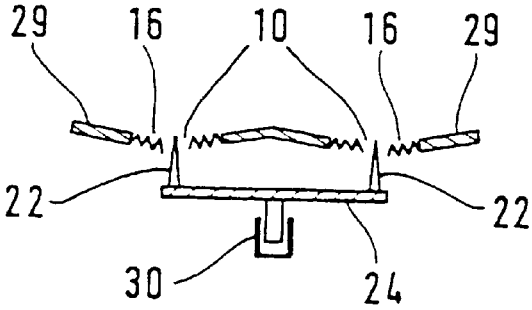
FIG. 6 is a sectional view of an embodiment taken along a line VI—VI of FIG. 1.

FIG. 1 furthermore shows one tine 22 of a cleaning rake 24 (shown in detail in FIG. 6) in each of the two screen openings 10. The tines 22 are introduced into the screen openings 10 from below in the area close to the longitudinal grooves 12 and are guided along inside these openings in the conveying direction 6. During this movement, they push any jammed solid piece 26 onward in the conveying direction 6, so that it becomes free. Then, the solid piece 26 falls through the screen opening 10 due to the widening thereof. The elastic construction of the edges of the screen openings 10 means that a solid piece 26 can only be jammed with a relatively low force, so that the load on the tines 22 and the cleaning rake 24 is low. After the cleaning rake 24 has been guided through the screen openings 10 in the conveying direction 6 as far as the end 14 of the separating device, it is pulled out of the screen openings 10 and moved back to its starting position at the beginning of the longitudinal grooves 12, where the tines 22 can again be introduced into the screen openings 10.

Figure 2:
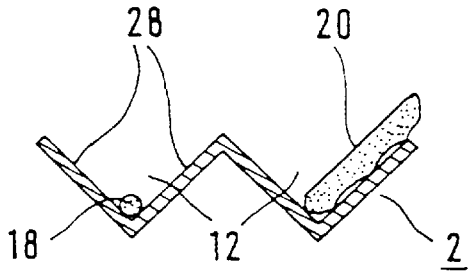
FIGS. 2 and 3 are sectional views of two embodiments taken along respective lines II—II and III—III of FIG. 1.
Figure 3:
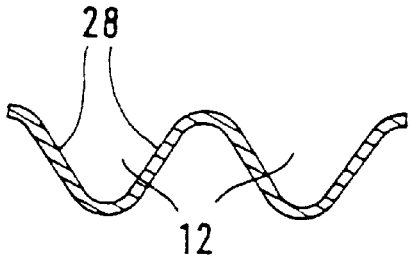

FIGS. 2 and 3 each illustrate a sectional view through the vibrating base 2 in the feed area 4, which is taken along a respective line II—II and III—III in FIG. 1. In accordance with FIG. 2, the vibrating base 2 has a sawtooth-like profile with V-shaped grooves, which are the longitudinal grooves 12. In accordance with FIG. 3, in contrast, the vibrating base 2 has a wavy profile. It can be seen in FIG. 2 that an elongate solid piece 18 and a wide solid piece 20 are aligning themselves in the longitudinal grooves 12. The sawtooth-like profile is advantageous in particular for aligning elongate solid pieces 18.

Figure 4:
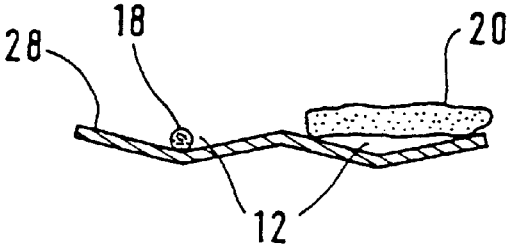
FIGS. 4 and 5 are sectional views of two embodiments taken along respective lines IV—IV and V—V of FIG. 1.
Figure 5:
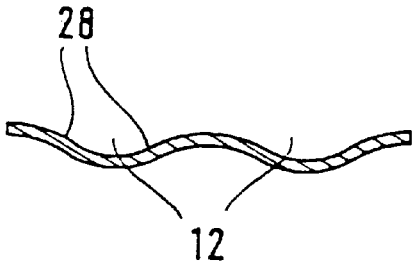

FIGS. 4 and 5 are sectional views which respectively show the sawtooth-like and the wavy profile and are taken along lines IV—IV and V—V through the screen base 2, specifically immediately before the screen openings 10 begin. It can be seen that in this area the depth of the longitudinal grooves 12 is significantly less. While inclined side walls 28 of the longitudinal grooves 12 in accordance with FIGS. 2 and 3 are still very steep, they are extremely shallow in the views shown in FIGS. 4 and 5. Therefore, the wide solid piece 20 will lie flat over the longitudinal groove 12, as shown in FIG. 4.

The side walls 28 are continued in the area of the screen openings 10 as screen walls 29. The elastic tabs 16 are attached to edges of these walls, as can be seen from FIG. 6. The screen walls 29 may either be flat or, as illustrated, form a profile. The tines 22 of the cleaning rake 24 can be seen to engage in the screen openings 10. The cleaning rake 24 is guided, for example, in a rail 30.

We claim:

1. A separating device for elongate solid pieces, comprising:

a vibrating base having a number of longitudinal grooves extended in a conveying direction, said longitudinal grooves having a depth decreasing along said conveying direction; and screen openings adjoining said longitudinal grooves for separating elongate solid pieces.

2. The separating device according to claim 1, wherein said longitudinal grooves have inclined side walls.

3. The separating device according to claim 1, wherein said vibrating base has a wavy profile.

4. The separating device according to claim 1, wherein said vibrating base has a sawtooth-like profile.

5. The separating device according to claim 1, wherein said longitudinal grooves are parallel and said adjoining screen openings are parallel.

6. The separating device according to claim 1, wherein said vibrating base has an end as seen in said conveying direction, and said screen openings extend to said end.

7. The separating device according to claim 1, wherein said screen openings widen in said conveying direction.

8. The separating device according to claim 1, wherein said screen openings widen continuously in said conveying direction.

9. The separating device according to claim 1, wherein said screen openings widen continuously in a V shape in said conveying direction.

10. The separating device according to claim 1, wherein said screen openings have elastic edges.

11. The separating device according to claim 1, wherein said screen openings have edges with elastic tabs, and said tabs narrow in said conveying direction causing said screen openings to widen in said conveying direction.

12. The separating device according to claim 1, including a cleaning rake, said cleaning rake having a number of tines to be introduced into said screen openings and moved in said screen openings.

13. The separating device according to claim 1, wherein said vibrating base is made of metal.

* * * * *